US006233852B1

(12) United States Patent
Pemberton

(10) Patent No.: US 6,233,852 B1
(45) Date of Patent: May 22, 2001

(54) UNIVERSAL COUPLER FOR EXCAVATOR BUCKETS

(75) Inventor: Walter Bruce Pemberton, Fern Park, FL (US)

(73) Assignee: Pemberton, Inc., Longwood, FL (US)

( * ) Notice: Subject to any disclaimer, the term of this patent is extended or adjusted under 35 U.S.C. 154(b) by 0 days.

(21) Appl. No.: 09/228,675

(22) Filed: Jan. 12, 1999

Related U.S. Application Data

(60) Provisional application No. 60/071,236, filed on Jan. 12, 1998.

(51) Int. Cl.[7] ..... E02F 3/96
(52) U.S. Cl. ..... 37/468; 414/723
(58) Field of Search ..... 37/468, 403; 414/723, 414/912; 403/321, 322.1

(56) References Cited

U.S. PATENT DOCUMENTS 4,810,162 * 3/1989 Foster ..... 414/723
4,881,867 * 11/1989 Essex et al. ..... 414/723
5,082,389 * 1/1992 Balemi ..... 37/468 X
5,179,794 * 1/1993 Ballinger ..... 414/723 X
5,350,250 * 9/1994 Nagler ..... 414/723 X
5,423,625 * 6/1995 Gebauer et al. ..... 37/468 X
5,456,030 * 10/1995 Barone et al. ..... 37/468
5,549,440 * 8/1996 Cholakon et al. ..... 414/723

FOREIGN PATENT DOCUMENTS

28407 * 1/1993 (AU) ..... 37/468

* cited by examiner

*Primary Examiner*—H. Shackelford
(74) *Attorney, Agent, or Firm*—James H. Beusse, Esq.; Holland & Knight LLP

(57) ABSTRACT

A coupler device for adapting a variety of excavator apparatuses to engage a variety of excavating buckets. The coupler device has a mounting plate, a connecting device for connecting the mounting plate to the excavator apparatus, and a device for connecting the mounting plate to the excavating bucket. The device connecting the mounting plate to the excavator apparatus may include a plurality of holes adapted to fit a variety of excavator apparatuses. The device for connecting the mounting plate to the excavating bucket may include a front hook, a rear hook, and a device moving the rear hook with respect to the front hook to adapt to a variety of excavating buckets. The device for moving the rear hook may include a captured bolt threaded through a cast box support that is attached to the slidable plate.

10 Claims, 6 Drawing Sheets

UNIVERSAL COUPLER FOR EXCAVATOR BUCKETS

This application is a continuation-in-part of U.S. provisional application Ser. No. 60/071,236 filed Jan. 12, 1998.

FIELD OF THE INVENTION

This invention relates generally to the field of earth moving machinery and more particularly to an adjustable coupler system for coupling a variety of earth moving buckets of different sizes and different manufacturers to a variety of sizes of hydraulic excavators.

BACKGROUND OF THE INVENTION

Manufacturers of hydraulic excavator machines are notorious for constructing the connection end of the machine, called the stick or boom, such that only buckets specifically designed for that model of machine can be attached. As a result, distributors and users of the machines are forced to carry a large inventory of buckets in order to have buckets of varying sizes (widths and capacities) for each machine owned or leased. Such inventory is expensive and space consuming. Accordingly, it is desirable to provide a mechanism that would allow different sizes and styles of buckets to be coupled to any one of a variety of hydraulic excavators.

SUMMARY OF THE INVENTION

The present invention discloses a coupler device for releasably interconnecting an excavating bucket having a pair of pins to an excavator apparatus. The coupler device includes a mounting plate, a means for connecting the mounting plate to the excavator pigging mechanism, and a means for connecting the mounting plate to the excavating bucket.

The means for connecting the mounting plate to the excavator apparatus in one embodiment includes a first pin and a second pin, and a first flange member and a second flange member spaced apart from the first flange member, wherein the first flange member and the second flange member are both attached to an upper surface of the mounting plate. In one embodiment of the present invention, the first flange member and the second flange member each contain two holes such that the first pin aligns with and passes through a first hole in the first flange member, then through corresponding holes in the excavator apparatus, then through a matching hole in the second flange member, while the second pin aligns with and passes through a second hole in the first flange member, then through corresponding holes in the excavator apparatus, then through a matching hole in the second flange member. In another embodiment of the present invention, the first flange member includes a third hole and the second flange member includes a third matching hole, wherein the third hole and the third matching hole are operable to receive the second pin. Adding a third hole to the flange members allows the coupler device to have a different spacing between the front and rear connection points for changing the effective leverage.

In another embodiment of the present invention the means for connecting the mounting plate to the excavator apparatus includes a first pin and a second pin, a first flange member and a second flange member spaced apart from the first flange member, wherein the first flange member and the second flange member are both attached to an upper surface of the mounting plate, and wherein the first flange member and the second flange member each include one hole such that the first pin aligns with and passes through the hole in the first flange member then through corresponding holes in the excavator apparatus, then through the hole in the second flange member, a slidable plate that is slidably attached to the mounting plate, and a third flange member and a fourth flange member spaced apart from the third flange member, wherein the third flange member and the fourth flange member are both attached to an upper surface of the slidable plate, and wherein the third flange member and the fourth flange member each include one hole such that the second pin aligns with and passes through the hole in the third flange member, then through corresponding holes in the excavator apparatus, then through the hole in the fourth flange member.

In one embodiment of the present invention, the means for connecting the mounting plate to the excavating bucket includes a forward-facing front hook that is attached to a lower surface of the mounting plate and is operable to engage a first of the pins on the excavating bucket, a slidable plate that is slidably attached to the mounting plate, a first side plate and a second side plate spaced apart from the first side plate, wherein the first side plate and the second side plate are both attached to a lower surface of the slidable plate and are formed with downward-facing U-shaped opening which are operable to engage a second pin on the excavating bucket, a forward-facing rear hook movably attached to the lower surface of the slidable plate, and a means for moving the rear hook with respect to the slidable plate so that the rear hook is operable to secure the second pin within the U-shaped openings.

In one embodiment of the present invention, the means for moving the rear hook includes a bolt support that is attached to the slidable plate and a bolt that is threaded through the bolt support and attached to the rear hook so that rotation of the bolt moves the rear hook axially of the slidable plate. The slidable plate may be moved axially along the mounting plate and, in one embodiment of the present invention, secured thereto using bolts.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
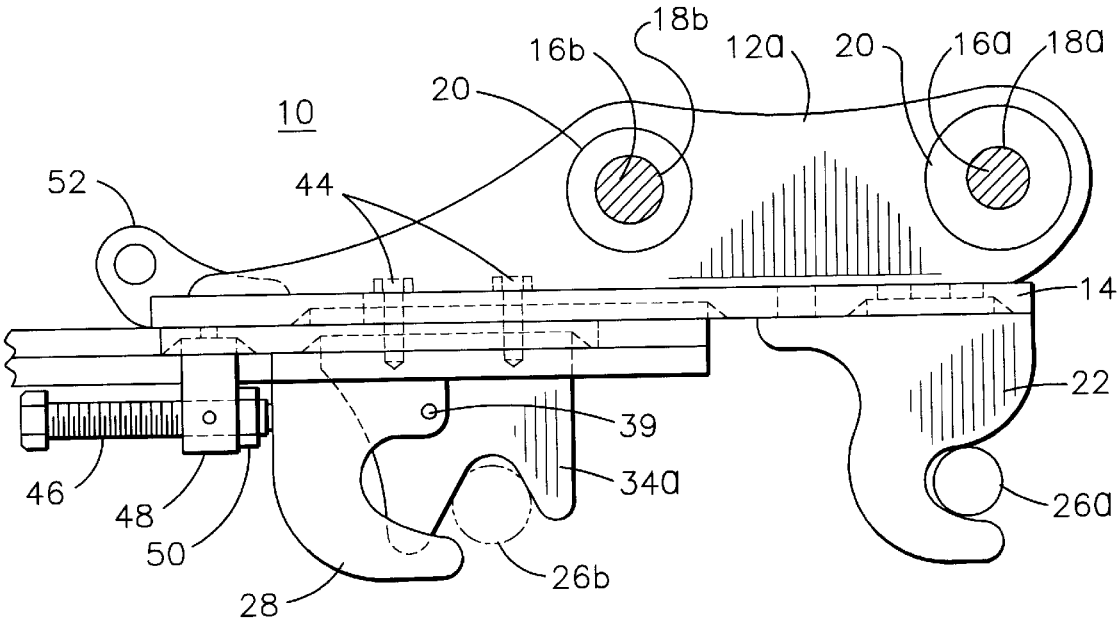
FIG. 1 is a side elevation view of a coupler constructed in accordance with the teachings of the present invention.
Figure 4:
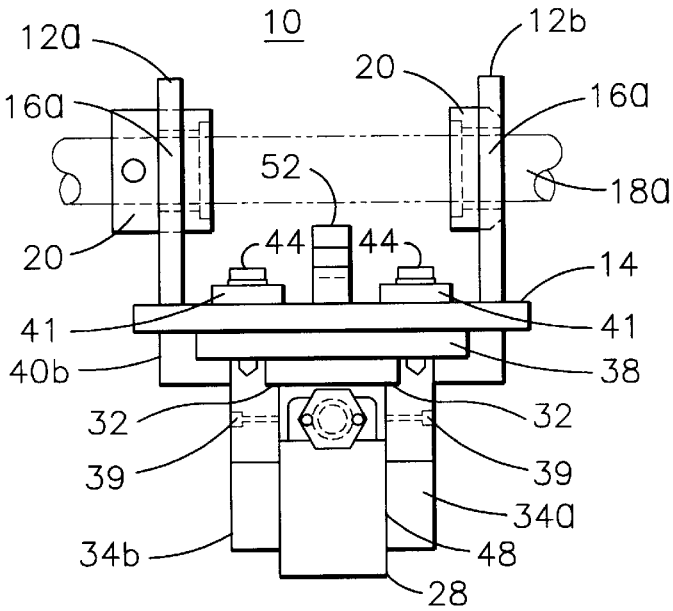
FIG. 4 is a rear end view of the coupler of FIG. 1.

Referring to the drawings in general and in particular to FIGS. 1 and 4, the present invention is implemented in a coupler 10 having a pair of spaced flange members 12*a*, 12*b* attached to an upper surface of a mounting plate 14. A pair of spaced holes 16*a*, 16*b* are formed in each flange member with the holes 16*a* and the holes 16*b* aligned in both flange members 12*a*, 12*b* for passing a pair of pins 18*a*, 18*b* shown in phantom. The pins 18*a*, 18*b* are used to connect the coupler 10 to an end of a stick on an earth moving machine, such as, for example, a Caterpillar 330B or a Daewoo DH280 excavator. Each of these excavators will have a different pin position, and the flanges 12*a*, 12*b* and holes 16*a*, 16*b* of the embodiment of FIG. 1 are uniquely adapted to fit and connect to one of these machines.

Figure 1A:
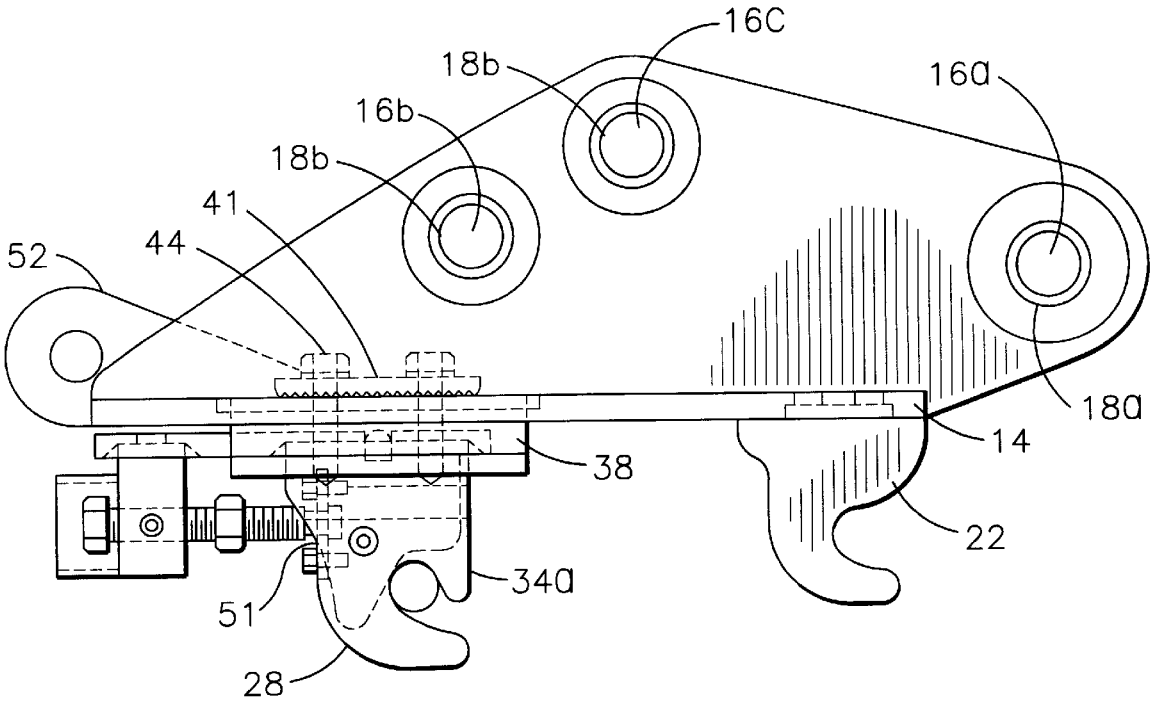
FIG. 1A is a side elevation view of an alternate embodiment of a coupler in accordance with the present invention.

Referring specifically to FIG. 1A, in another embodiment of the present invention, the spaced flange members 12*a*, 12*b* each contain an extra rear hole 16*c* which can be used for increased leverage. The third hole 16*c* is formed in each spaced flange member 12*a*, 12*b* as a connection point for a hydraulic powered lever arm with more spacing from the front pivot connection 16*a* for higher leverage.

Figure 1B:
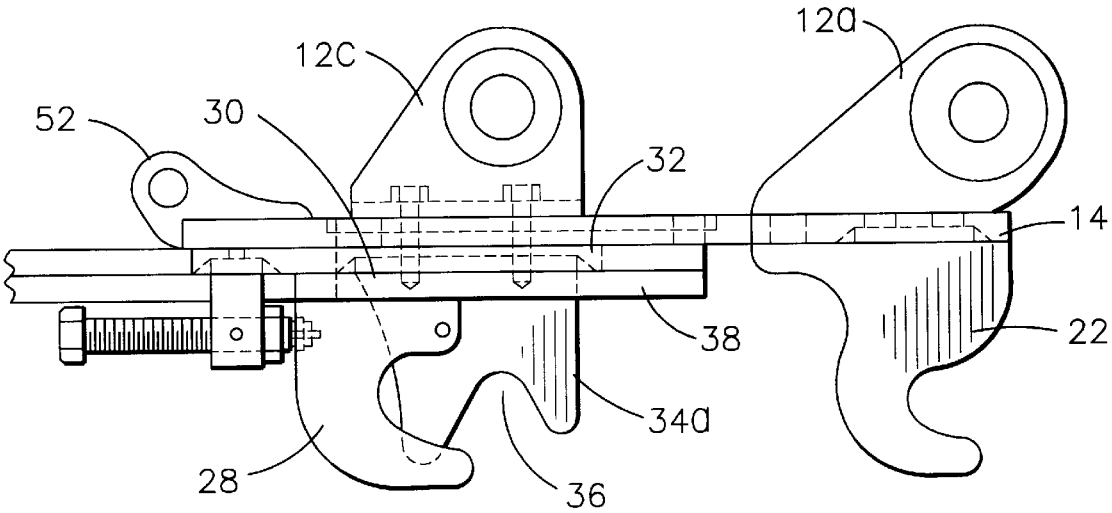
FIG. 1B is a side elevation view of an alternate embodiment of a coupler in accordance with the present invention.
Figure 1C:
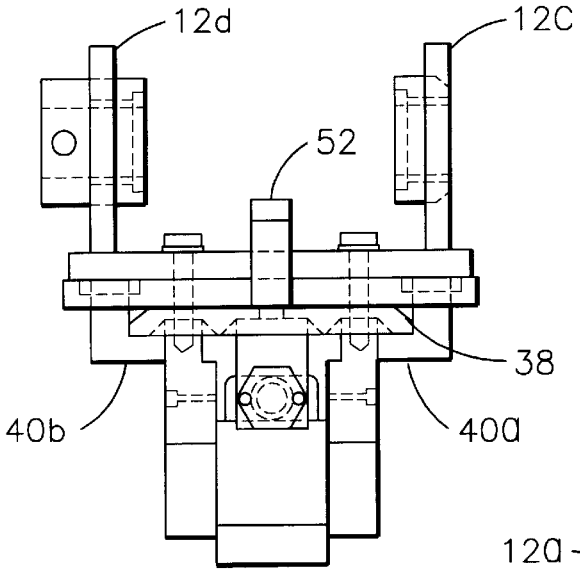
FIG. 1C is a rear elevation view of the coupler of FIG. 1B.
Figure 3:
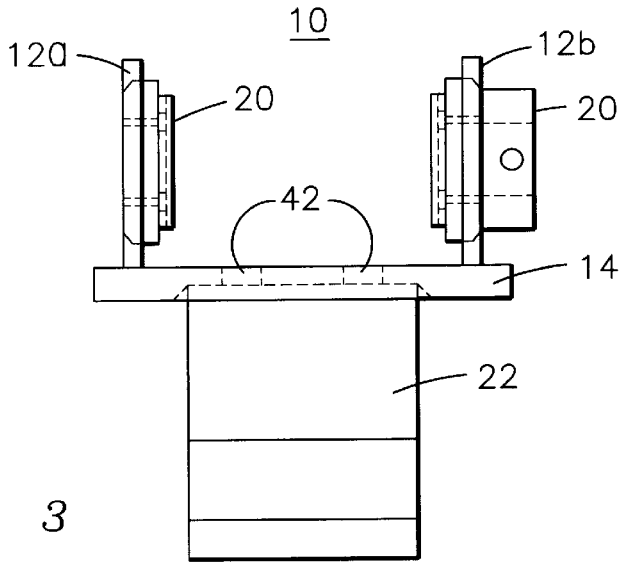
FIG. 3 is a front end view of the coupler of FIG. 1.

Referring specifically to FIGS. 1B, 1C AND 3, in yet another embodiment of the present invention, there are two pairs of spaced flange members 12*a*, 12*b*, 12*c*, 12*d*. A first pair of spaced flange members 12*a*, 12*b* are attached to the upper surface of the mounting plate 14 above a front hook 22. A second pair of spaced flange members 12*c*, 12*d* are attached to an upper surface of a slidable plate 38 which is slidably supported on a pair of L-shaped support brackets 40*a*, 40*b* that are attached to the mounting plate 14. Preferably, the brackets 40*a*, 40*b* are welded to the mounting plate 14. The slidable plate 38 can be moved to adjust the position of the second pair of spaced flange members 12*c*, 12*d* in relation to the first pair of spaced flange members 12*a*, 12*b* so that the coupler 10 may fit a larger number of earth moving machines.

Referring now to FIGS. 1 and 3, on a lower surface of the mounting plate 14 there is attached the front hook 22. As seen in the front view of FIG. 3, the hook 22 extends laterally about the width between the upper flanges 12*a*, 12*b*, thus providing a wide and robust hook. As will become apparent, the hook 22 is designed to fit about a pin on the top of a conventional excavator bucket.

Figure 5:
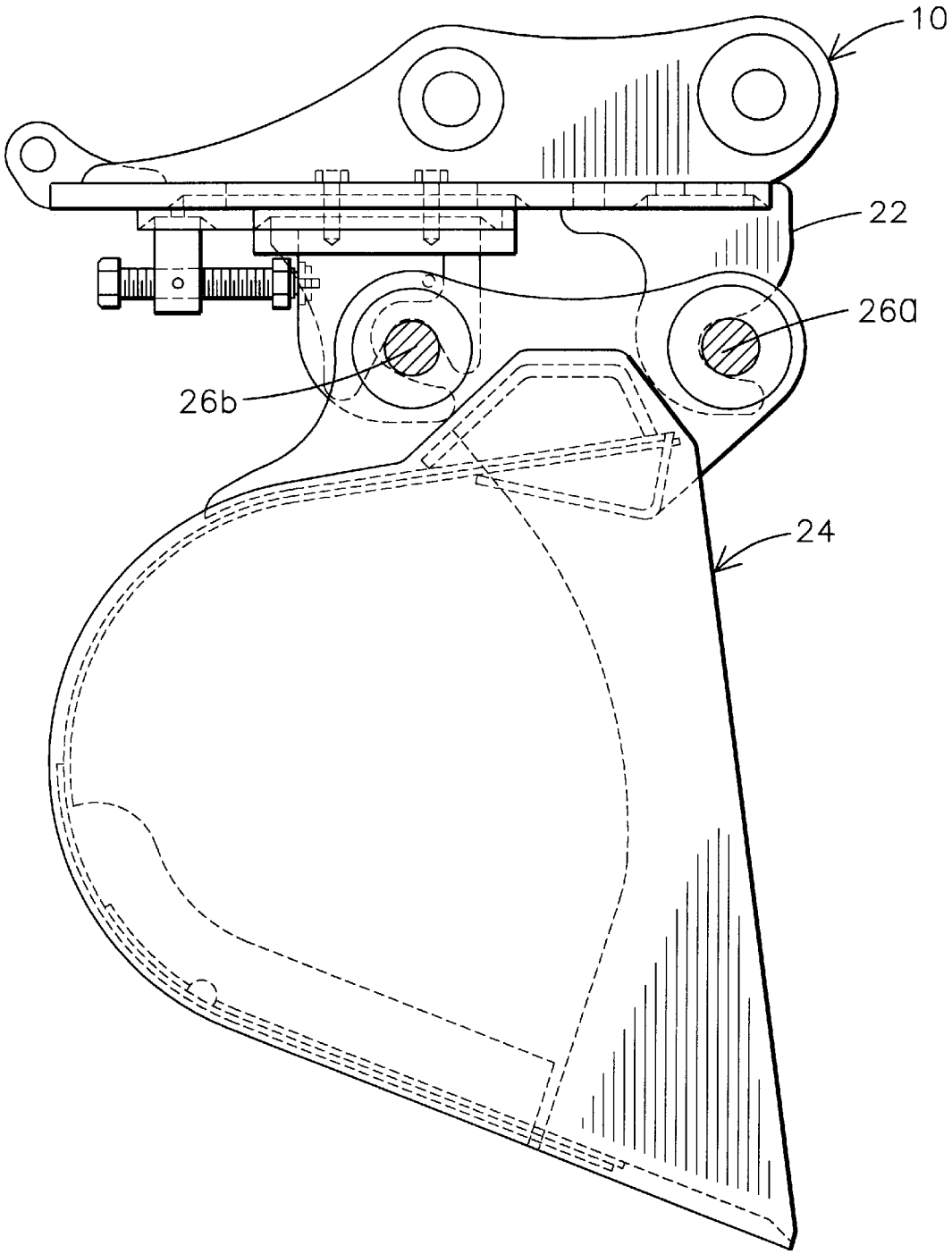
FIG. 5 is a simplified side view of an excavating bucket, excavator apparatus, and the coupler of FIG. 1 showing hook-up pin positions.

As shown in FIG. 5, each bucket 24 is fitted with a pair of spaced pins 26*a*, 26*b* which are normally used to couple the bucket 24 directly to the end of the excavator stick 27. Since the pin positions are dictated by the design of the stick end, buckets are generally unique to a particular stick. For that reason, any change in stick design and particularly in pin position, requires a different bucket. Pin diameters may also vary making buckets more unique. Further, buckets having different capacities, for example, ½ yard buckets as compared with 3 yard buckets, may have different widths. A bucket's pin width is usually set to match a particular excavator stick.

Referring to FIG. 1 and 4, side plates 34*a*, 34*b* are formed with inverted, generally U-shaped openings 36 sized to fit onto a rear pin 26*b* on an excavator bucket. The side plates 34*a*, 34*b* are positioned on either side of a rear hook 28 and cooperate with the rear hook 28 to create a positive locking mechanism for attaching a bucket 24 to the coupler 10. The side plates 34*a*, 34*b* are attached to a lower surface of the slidable plate 38. Preferably, the side plates 34*a*, 34*b* are welded to the slidable plate 38.

Figure 2:
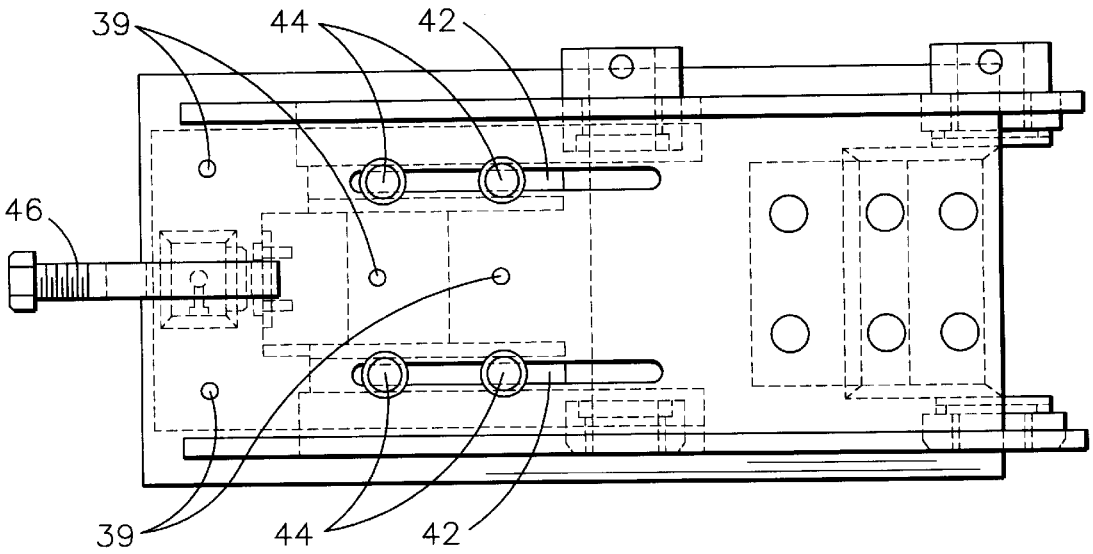
FIG. 2 is a top plan view of the coupler of FIG. 1B.

Referring to FIGS. 1, 2, and 4, the positions of the side plates 34*a*, 34*b* and their downward facing opening 36 is adjustable with respect to fixed front hook 22 so that the coupler can be used on different models and sizes of excavator buckets. Adjustment is attained by sliding the slidable plate 38 to the desired location, passing each of a pair of bolts 44 first through a locking bar 41 and then through one of the two slots 42 in the mounting plate 14, and threadedly engaging slidable plate 38. With the bolts 44 loosened, the plate 38 will slide on brackets 40*a*, 40*b* allowing the spacing between front hook 22 and openings 36 to be set to fit the spacing between a pair of bucket pins. The bolts 44 are then tightened to fix the position of plate 38. The locking bars 41 grip the mounting plate 14 and help ensure that the position of plate 38 remains fixed.

Referring now to FIG. 5, the rear pin 26*b* on a bucket 24 is also held by the rear hook 28. After the coupler 10 is placed on a bucket 24 and the slidable plate 38 is adjusted and secured in a position so that the side plates 34*a*, 34*b* engage the rear pin 26*b*, the rear hook 28 must be moved toward the front hook 22 in order to capture and hold the rear pin 26*b* in the clevis formed by opening 36.

The rear hook 28 is movably attached to the lower surface of the slidable plate 38. More precisely, the rear hook 28 includes an upper support plate 30 which rides on the shoulders 32 of the side plates 34*a*, 34*b*. In the embodiment of FIG. 1, this adjustment is achieved by a captured bolt 46 threaded through a cast box support 48 which is welded to slidable plate 38. The cast box support 48 contains a large nut that is captured within the box 48. This nut can be replaced if its threads are damaged. A locking nut 50 is used to prevent inadvertent retraction of bolt 46. A guide block 51 is attached to the end of the captured bolt 46 and the rear hook 28. As the captured bolt 46 is threaded through the cast box support 48, the guide block 51 applies a lateral force to the rear hook 28, causing the upper support plate 30 to move on the shoulders 32 of the pair of spaced side plates 34*a*, 34*b*. In this way, the position of the rear hook 28 in relation to the side plates 34*a*, 34*b* can be altered so that the rear hook 28 may securely engage the rear pin 26*b* of the bucket 24.

Note that a hook-up bracket 52 may be welded to the mounting plate 14 for connecting a cable or chain which may be used to lift various items such as pipe being laid in an excavated trench. In addition, conventional Zerk type grease fittings 39 are provided to lubricate sliding interfaces throughout the coupler 10, as illustrated in FIG. 2.

Figure 6:
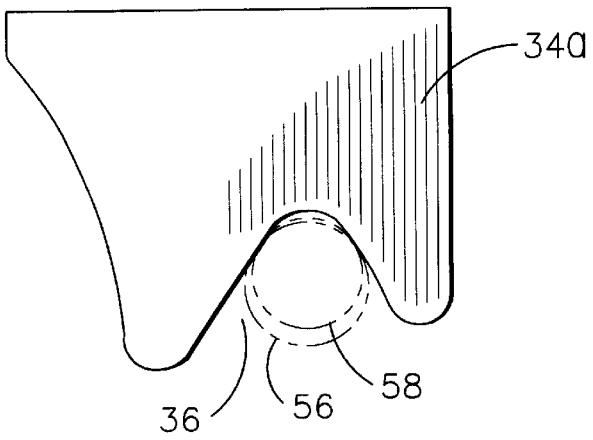
FIG. 6 is a side view of a portion of one of the hooks of the coupler of FIG. 1 showing the hook opening.
Figure 7:
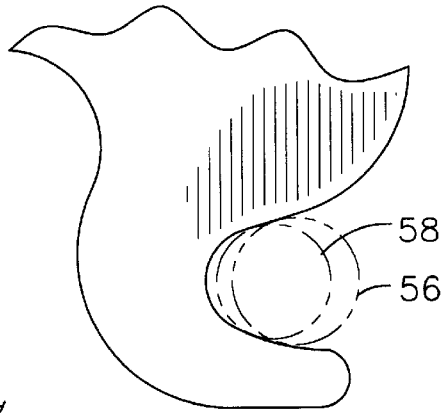
FIG. 7 is a side view of the clevis plate of the coupler of FIG. 1 showing the opening design.

It will be noted that each hook 28 and 22 and the side plates 34*a*, 34*b* are formed with openings that are not uniformly circular. The openings, such as opening 36, are designed to provide maximum contact surface on the bucket pins and to have a constricting shape in which the pins do not immediately bottom out in the openings. Referring to FIG. 6, the opening 36 of plate 34*a* is defined within an arc of 56° with the forward inner surface lying on an arc of 8 inch radius. As shown by the two different pin diameters at lines 56 and 58, the contact surfaces are maximized without bottoming of the pins so that different size pins can be engaged with one size opening. Similarly, as shown in FIG. 7, the opening of the hook 22 is designed for the same type contact but is formed with an opening of 28° of arc. The inner lower surface is formed with an 8 inch radius. It is anticipated that the bucket pins may be manufactured of a low hardness steel that will allow some outer surface deformation of the pins in order to increase the surface contact with the hooks 22, 28 and plates 34*a*, 34*b*.

Figure 8:
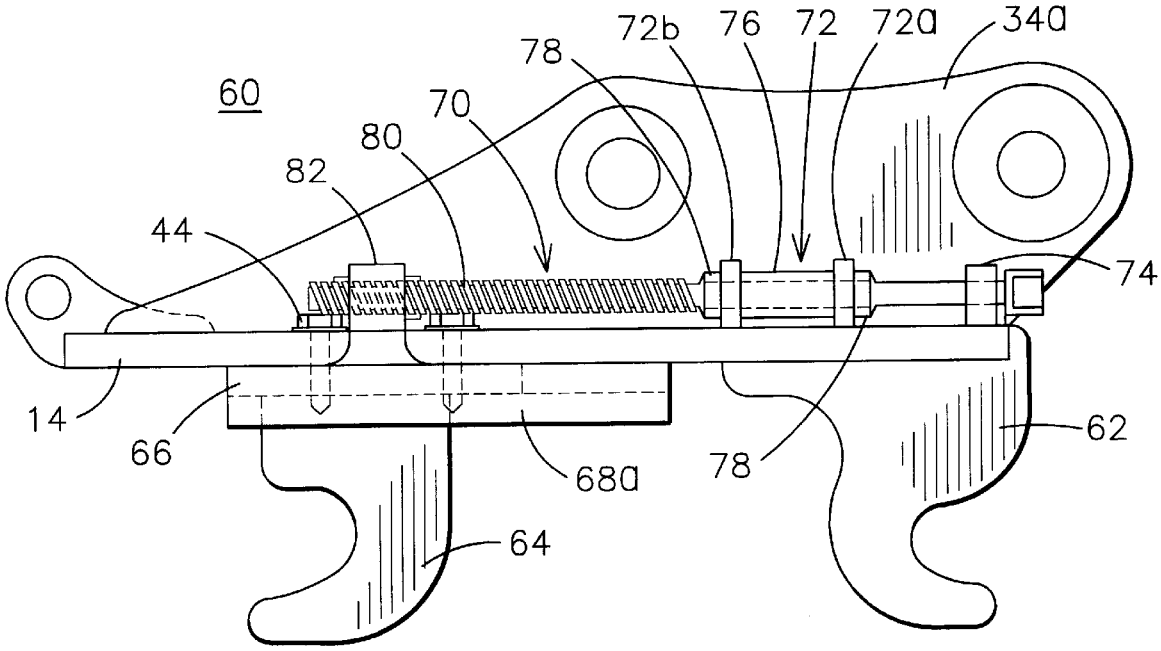
FIGS. 8 and 8A are elevation and plan views of an alternate embodiment of the coupler of FIG. 1.
Figure 8A:
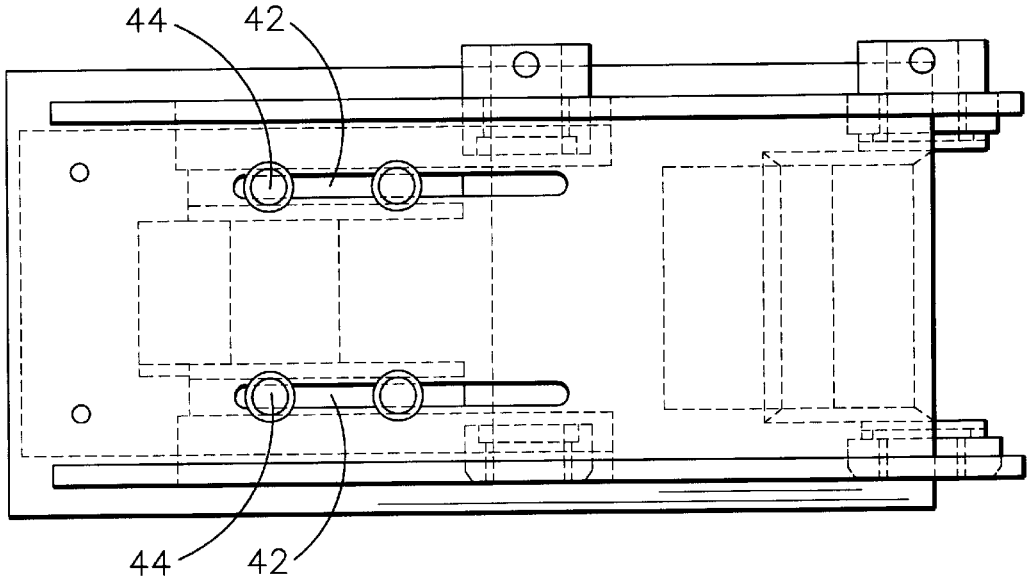

FIGS. 8 and 8*a* illustrate an alternate embodiment of a coupler 60 for an excavator bucket. The coupler 60 uses a pair of oppositely facing hooks 62 and 64 with the rear hook 64 being slidably adjustable. The upper portion of the coupler 60, i.e., the mounting plate 14 and flange members 12*a*, 12*b*, are substantially identical to the embodiment of the coupler 10 of FIG. 1. In FIG. 8, the rear hook 64 is attached to a plate 66 which is supported by a pair of rails 68*a*, 68*b* welded to the underside of plate 14 in a manner similar to the support brackets 40*a*, 40*b* of FIG. 4. The slots 42 in plate 14 are similarly used with the bolts 44 to lock the plate 66 in position once the rear hook 64 has engaged the rear pin on the bucket. Adjustment of rear hook position is achieved via a captured bolt 70 rotatably fixed to mounting plate 14 by a pair of guide brackets 72*a*, 72*b*. The bolt 70 passes through a standard 74 with the bolt head bearing against the standard. The brackets 72*a*, 72*b* support a sleeve 76 between raised bosses 78 on the bolt so as to maintain its axial position. A threaded end 80 of bolt 70 engages a threaded block 82 attached to plate 66 so that rotation of bolt 70 will move plate 66 axially of the bolt. In this embodiment, locking of the position of hook 64 is assured by tightening of bolts 44.

Figure 9:
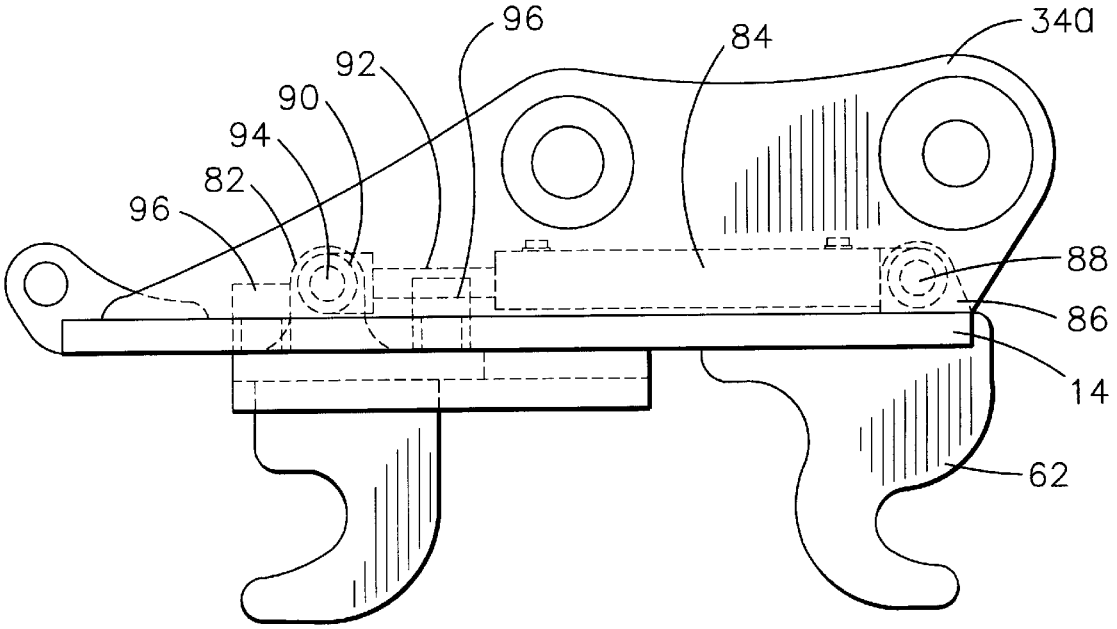
FIG. 9 illustrates application of hydraulic actuators to the embodiment of FIG. 8.

FIG. 9 illustrates another apparatus for positioning rear hook 64 of coupler 60. The adjusting bolt 70 of FIG. 8 is replaced by a dual-acting hydraulic cylinder 84 mounting to plate 14 by a bracket 86 and pin 88 in a conventional cylinder mounting arrangement. An end 90 of piston rod 92 is connected to block 82 by a pin 94 extending through the end 90 and the block 82. The bolts 44 of FIG. 8 are replaced by hydraulic locking cylinders 96 such as the type manufactured by Applied Power, Inc., Model ENERPAC RWH120. The advantage of this hydraulic system is that the coupler connections can now be remotely controlled and the hydraulic cylinders will exert a uniform pressure without loosening as might occur with threaded adjustors and fasteners. Further, the cylinders exert a pre-set force and avoid problems associated with under or over-torquing of threaded bolts.

The system of FIG. 9 can also be applied to the embodiment of FIGS. 1–3 by replacing the bolt 46 with a hydraulic cylinder such as shown at 84 and replacing bolts 44 by hydraulic cylinders such as shown at 96.

What is claimed is:

1. A coupler device for coupling an excavator bucket to an excavator apparatus comprising:

a mounting plate;

a forward-facing front hook attached to a lower surface of said mounting plate and operable to engage a first mounting pin on the excavating bucket;

a slidable plate slidably attached to said mounting plate;

a first side plate and a second side plate spaced apart from said first side plate, said first side plate and said second plate both being attached to a lower surface of said slidable plate and being formed with downward-facing U-shaped openings, said U-shaped opening operable to engage a second mounting pin on the excavating bucket;

a forward-facing rear hook movably attached to the lower surface of said slidable plate; and a means for moving said forward-facing rear hook with respect to said slidable plate so that said rear hook is operable to secure said second mounting pin within said U-shaped openings.

2. The coupler device as set forth in claim 1 wherein said slidable plate slidably rides on a pair of L-shaped support brackets that are attached to said mounting plate.

3. The coupler device as set forth in claim 2 further comprising a slot in said mounting plate and a bolt that may be inserted into said slot and used to threadedly engage said slidable plate.

4. The coupler device as set forth in claim 1 wherein said means for moving said forward-facing rear hook further comprises a bolt support that is attached to said slidable plate and a bolt that is threaded through said bolt support and attached to said rear hook so that rotation of said bolt moves the rear hook axially of said slidable plate.

5. A coupler device for coupling an excavator bucket to an excavator apparatus comprising:

a mounting plate;

a forward-facing front hook attached to a lower surface of said mounting plate and operable to engage a first mounting pin on said excavating bucket;

a slidable plate slidably attached to said mounting plate;

a rear hook movably attached to a lower surface of said slidable plate; and a means for moving said rear hook with respect to said slidable plate so that said rear hook is operable to engage a second mounting pin on said excavating bucket.

6. The coupler device as set forth in claim 5 wherein said slidable plate slidably rides on a pair of L-shaped support brackets that are attached to said mounting plate.

7. The coupler device as set forth in claim 6 further comprising a slot in said mounting plate and a bolt that may be inserted into said slot and used to threadedly engage said slidable plate.

8. The coupler device as set forth in claim 5 wherein said means for moving said rear hook further comprises a bolt support that is attached to said slidable plate and a bolt that is threaded through said bolt support and attached to said rear hook so that rotation of said bolt moves the rear hook axially of said slidable plate.

9. The coupler device as set forth in claim 6 further comprising a slot in said mounting plate and a hydraulic cylinder that may be inserted into said slot and used to engage said slidable plate.

10. The coupler device as set forth in claim 5 wherein said means for moving said rear hook further comprises a hydraulic cylinder.

* * * * *